US009445200B2

(12) United States Patent
Kim et al.

(10) Patent No.: US 9,445,200 B2
(45) Date of Patent: Sep. 13, 2016

(54) PIEZOELECTRIC SPEAKER HAVING WEIGHT AND METHOD OF PRODUCING THE SAME

(71) Applicant: Electronics and Telecommunications Research Institute, Daejeon (KR)

(72) Inventors: Hye Jin Kim, Daejeon (KR); Woo Seok Yang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 608 days.

(21) Appl. No.: 13/651,228

(22) Filed: Oct. 12, 2012

(65) Prior Publication Data

US 2013/0301856 A1 Nov. 14, 2013

(30) Foreign Application Priority Data

May 14, 2012 (KR) ..... 10-2012-0050738
Jun. 12, 2012 (KR) ..... 10-2012-0062662

(51) Int. Cl.
*H04R 7/26* (2006.01)
*H04R 17/00* (2006.01)
(Continued)

(52) U.S. Cl.
CPC . *H04R 7/26* (2013.01); *H04R 7/04* (2013.01); *H04R 7/20* (2013.01); *H04R 17/00* (2013.01);
(Continued)

(58) Field of Classification Search
CPC ..... H04R 2307/023; H04R 2307/027; H04R 2307/025; H04R 2307/201; H04R 7/04; H04R 7/06; H04R 7/10; H04R 7/20; H04R 7/26; H04R 17/005; H04R 17/02; H04R 17/025
USPC ..... 381/190, 191, 173–175
See application file for complete search history.

(56) References Cited

U.S. PATENT DOCUMENTS 2,910,545 A * 10/1959 Glenn ..... B06B 1/0666 310/326
4,047,060 A * 9/1977 Schafft ..... G10K 9/122 310/322

(Continued)

FOREIGN PATENT DOCUMENTS

CN 1512481 A 7/2004
CN 201185473 Y 1/2009

(Continued)

OTHER PUBLICATIONS

Chinese Office Action for Chinese Application No. 201210519474.8, dated Nov. 26, 2015.

*Primary Examiner* — Davetta W Goins
*Assistant Examiner* — Jasmine Pritchard

(57) ABSTRACT

The present disclosure relates to a piezoelectric speaker having a weight that enables a frequency response characteristic of the piezoelectric speaker to be uniform by disposing a weight of a flexible material on an acoustic diaphragm or on and below an acoustic diaphragm of the piezoelectric speaker, thereby enhancing flatness of sound. The piezoelectric speaker having the weight includes a piezoelectric device having a piezoelectric layer and an electrode formed on or on and below the piezoelectric layer to apply an electrical signal to the piezoelectric layer; an acoustic diaphragm having a wider area than the piezoelectric device and bonded on one surface of the piezoelectric device; a frame disposed in a form that surrounds a side surface of the acoustic diaphragm; and a weight disposed above the acoustic diaphragm or above and below the acoustic diaphragm on which the piezoelectric device is disposed to thereby control a vibration.

20 Claims, 7 Drawing Sheets

(51) Int. Cl.
*H04R 7/04* (2006.01)
*H04R 31/00* (2006.01)
*H04R 7/20* (2006.01)

(52) U.S. Cl.
CPC ..... *H04R 31/003* (2013.01); *H04R 2307/023* (2013.01); *H04R 2307/025* (2013.01); *H04R 2307/027* (2013.01); *H04R 2307/207* (2013.01); *H04R 2499/11* (2013.01); *H04R 2499/15* (2013.01); *Y10T 156/10* (2015.01)

(56) References Cited

U.S. PATENT DOCUMENTS 4,283,605 A * 8/1981 Nakajima ..... H04R 17/00 381/190
4,591,667 A * 5/1986 Hino ..... H04R 9/06 381/407
4,654,554 A * 3/1987 Kishi ..... H04R 1/22 310/322
5,118,981 A * 6/1992 Kobayashi ..... B60G 17/01941 310/324
6,747,395 B1 * 6/2004 Satoh ..... H04R 17/005 310/324
7,692,363 B2 * 4/2010 Butler ..... B06B 1/0603 310/329
8,058,774 B2 * 11/2011 Fujimoto ..... H01L 41/1134 310/324
8,094,843 B2 1/2012 Eaton
2008/0170982 A1 * 7/2008 Zhang ..... B82Y 10/00 423/447.3
2009/0196442 A1 8/2009 Eaton
2010/0007243 A1 * 1/2010 Engel ..... H01L 41/083 310/322
2012/0099746 A1 4/2012 Fujise
2014/0145836 A1 * 5/2014 Tossavainen ..... G06F 3/016 340/407.2

FOREIGN PATENT DOCUMENTS

JP 2001-016691 B2 1/2001
JP 2011-244379 A 12/2011
KR 1020110033593 A 3/2011
KR 1020120027915 A 3/2012

* cited by examiner

<PRIOR ART>

<PRIOR ART>

<PRIORT ART>

PIEZOELECTRIC SPEAKER HAVING WEIGHT AND METHOD OF PRODUCING THE SAME

CROSS-REFERENCE TO RELATED APPLICATIONS

This application is based on and claims priority from Korean Patent Application No. 10-2012-0050738, filed on May 14, 2012, and Korean Patent Application No. 10-2012-0062662, filed on Jun. 12, 2012 with the Korean Intellectual Property Office, the disclosure of which is incorporated herein in its entirety by reference.

TECHNICAL FIELD

The present disclosure relates to a piezoelectric speaker having a weight and a method of producing the same, and more particularly, to a piezoelectric speaker having a weight that enables a frequency response characteristic of the piezoelectric speaker to be uniform by disposing a weight of a flexible material on an acoustic diaphragm or on and below an acoustic diaphragm of the piezoelectric speaker, thereby enhancing flatness of sound, and a method of producing the same.

BACKGROUND

Currently, ultra slimness of an organic light emitting diode (OLED) television (TV) and the like, aside from a portable terminal such as a mobile phone, a smart phone, a tablet personal computer (PC), and the like, has become a trend. Accordingly, a piezoelectric speaker capable of overcoming constraints in a thickness of an existing dynamic speaker using a magnetic coil is in the spotlight. Compared to the existing dynamic speaker, the piezoelectric speaker has advantages in being thin, light, and consuming low power. Accordingly, the piezoelectric speaker has been aggressively explored as a futuristic speaker capable of replacing the existing dynamic speaker.

The piezoelectric speaker does not use the magnetic coil, which is different from the existing dynamic speaker, and is driven based on a principle of aggressively employing resonance of a piezoelectric thin film itself. That is, due to contraction and expansion of a piezoelectric thin film occurring when an alternating current (AC) signal is input to the piezoelectric thin film, displacement occurs on a diaphragm and sound is reproduced by forming a dilatational wave in the air based on a mode-displacement characteristic according to a frequency. Based on the above principle, the piezoelectric speaker is driven. Accordingly, the piezoelectric speaker includes a plurality of resonant modes in a frequency response characteristic and thus, has a disadvantage in that a peak-dip or hump-hollow easily occurs. That is, due to the above peak-dip phenomenon of the frequency response characteristic, output of the piezoelectric speaker becomes unstable, distortion of sound becomes easy, and sound quality of sound reproduced is degraded.

As a conventional method for enhancing the above sound quality issue of the piezoelectric speaker, a method of bonding piezoelectric devices having different resonant frequencies on both surfaces of a diaphragm, respectively (Korean Patent Application No. 10-2010-0027915), a method of increasing a mass of a piezoelectric body by disposing a vibration adjusting portion at a center of a piezoelectric thin film (Korean Patent Application No. 10-2000-0032846 and U.S. patent application Ser. No. 12/023,496), and the like are proposed. However, the conventional methods adjust an amplitude by lowering a resonant frequency and thus, generally enhance a peak-dip in the lower register.

SUMMARY

The present disclosure has been made in an effort to provide a piezoelectric speaker that enhances a peak-dip phenomenon of a frequency response characteristic and has uniform sound quality by disposing a weight of a flexible material on an acoustic diaphragm or on and below an acoustic diaphragm of the piezoelectric speaker, and a method of producing the same.

An exemplary embodiment of the present disclosure provides a piezoelectric speaker having a weight, including: a piezoelectric device having at least one piezoelectric layer and an electrode formed on or on and below the piezoelectric layer to apply an electrical signal to the piezoelectric layer; an acoustic diaphragm having a wider area than the piezoelectric device and bonded on one surface of the piezoelectric device; a frame disposed in a form that surrounds a side surface of the acoustic diaphragm; and a weight disposed above the acoustic diaphragm or above and below the acoustic diaphragm on which the piezoelectric device is disposed to thereby control a vibration.

Another exemplary embodiment of the present disclosure provides a method of producing a piezoelectric speaker having a weight, the method including: a piezoelectric device bonding step of bonding a piezoelectric device on an acoustic diaphragm using a high elastic damping material; an upper weight disposing step of disposing an upper weight of a flexible material above the acoustic diaphragm on which the piezoelectric device is bonded along a center of the acoustic diaphragm in a long shaft direction of the acoustic diaphragm; and a frame disposing step of disposing a frame in a form that surrounds a side surface of the acoustic diaphragm.

According to the exemplary embodiments of the present disclosure, by disposing a weight of a flexible material on or below an acoustic diaphragm of a piezoelectric speaker, it is possible to control an amplitude in a resonant mode of the piezoelectric speaker. Accordingly, it is possible to enhance a peak-dip phenomenon in a frequency response characteristic, and to improve sound quality by increasing flatness of sound.

According to the exemplary embodiments of the present disclosure, by adding a mass of a piezoelectric layer due to a weight of a flexible material disposed on or below the piezoelectric speaker, it is possible to decrease an initial resonant frequency of the speaker. Accordingly, a frequency band becomes wide and thus, it is possible to reproduce an ample output.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof The illustrative embodiments described in the detailed description, drawing, and claims are not meant to be limiting. Other embodiments may be utilized, and other changes may be made, without departing from the spirit or scope of the subject matter presented here.

Figure 1:
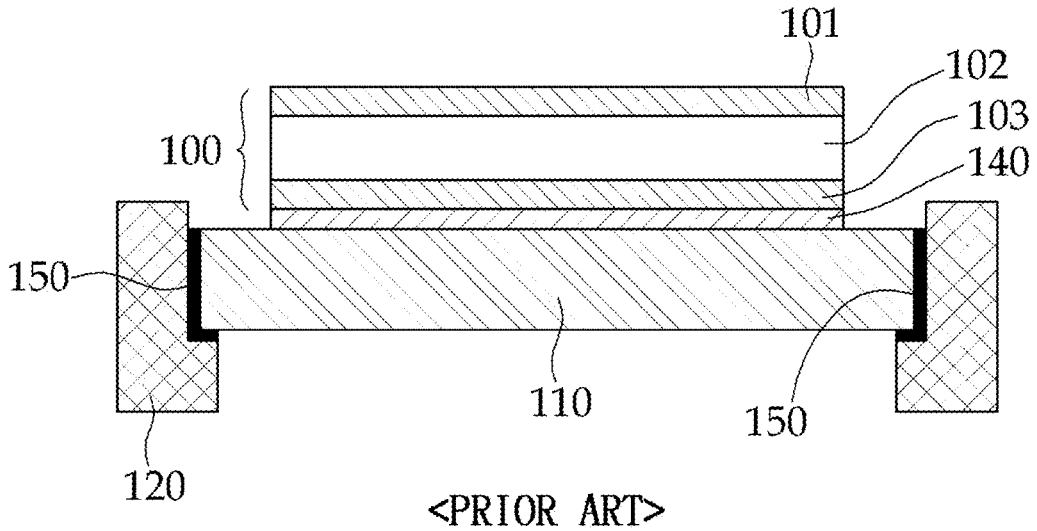
FIG. 1 is a cross-sectional view of a piezoelectric speaker according to a related art.
Figure 2:
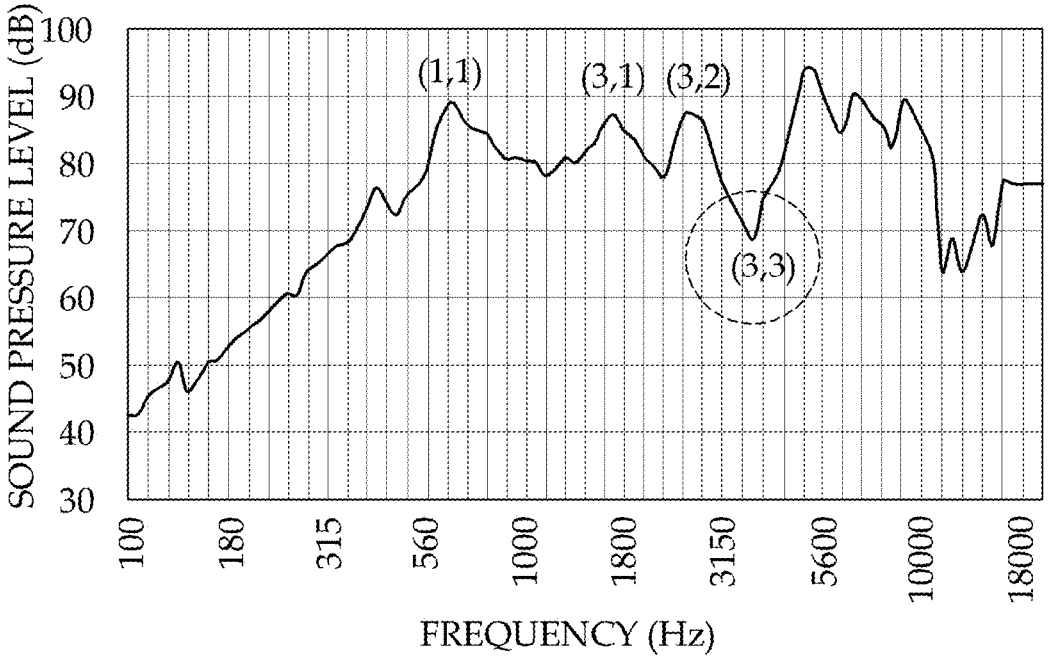
FIGS. 2 and 3 are a graph illustrating a frequency response characteristic, and a (3, 3 ) mode shape in a dip frequency of the piezoelectric speaker according to the related art, respectively.
Figure 3:
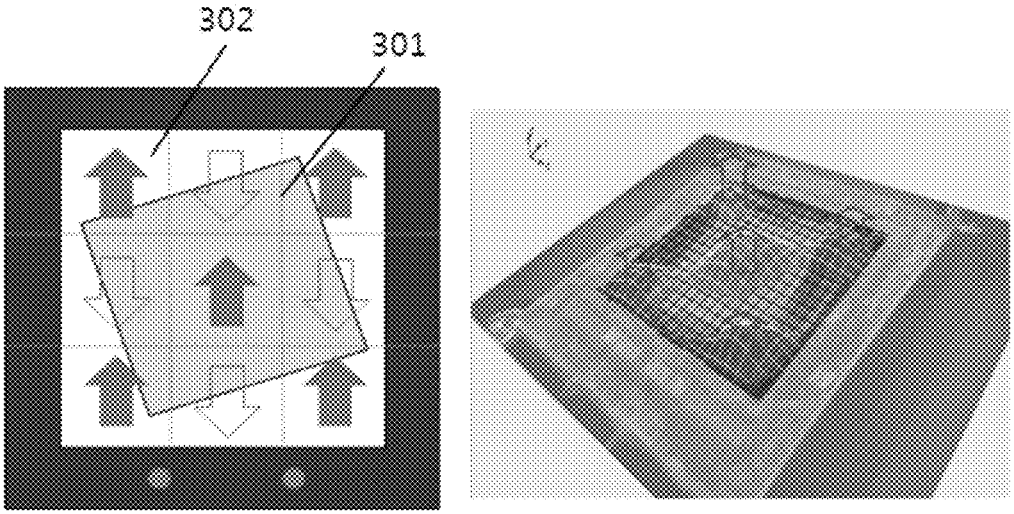

FIG. 1 is a cross-sectional view of a piezoelectric speaker according to a related art, and FIGS. 2 and 3 illustrate a frequency response characteristic, and a (3, 3) mode shape in a dip frequency of the piezoelectric speaker according to the related art, respectively.

Referring to FIG. 1, the piezoelectric speaker includes a piezoelectric device 100 having a piezoelectric layer 102 to drive a speaker and electrodes 101 and 103 formed on the piezoelectric layer 102 or on and below the piezoelectric layer 102, an acoustic diaphragm 110 bonded to the piezoelectric device 100, a high elastic damping material layer 140 bonding the piezoelectric device 100 and the acoustic diaphragm 110, a frame 120 disposed in a form that surrounds a side surface of the acoustic diaphragm 110, and the like.

The above piezoelectric speaker aggressively employs the piezoelectric layer 102 and a resonant mode of the acoustic diaphragm 110 and thus, a peak-dip in the frequency response characteristic frequently occurs as shown in FIGS. 2 and 3. The above peak-dip phenomenon makes an output characteristic of the piezoelectric speaker unstable and degrades sound quality.

The present disclosure is proposed to enhance the above peak-dip of the piezoelectric speaker and to enable the piezoelectric speaker to have a uniform frequency response characteristic by narrowing an output sound pressure deviation.

A peak-dip of the piezoelectric speaker of FIG. 2 was based on an odd-numbered mode and an even-numbered mode and was experimentally analyzed. In particular, it was verified that the largest dip in a play frequency band of the piezoelectric speaker occurred in a (3, 3 ) mode.

Referring to FIG. 3, in the (3, 3 ) mode, it is possible to predict that while displacement according to vibration of the piezoelectric speaker alternates into an upper direction or a lower direction of an acoustic diaphragm 302, divisional vibration will occur. Accordingly, by further providing supporters 301 on and below the acoustic diaphragm 302 that is distorted in divisional vibration of the acoustic diaphragm 302 and thereby adding rigidity to the acoustic diaphragm 302, it is possible to control the displacement and thereby enhance a peak-dip. That is, it is possible to enhance the peak-dip phenomenon by disposing a weight of a flexible material on a portion in which the divisional vibration of the acoustic diaphragm 302 distorted in a high-order mode of the piezoelectric speaker occurs, and thereby controlling displacement.

Figure 4:
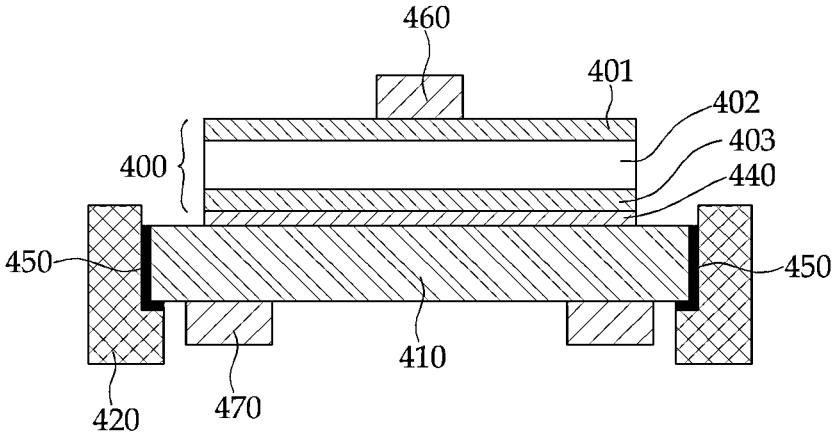
FIGS. 4 and 5 are cross-sectional views of a piezoelectric speaker according to a first exemplary embodiment of the present disclosure.
Figure 5:
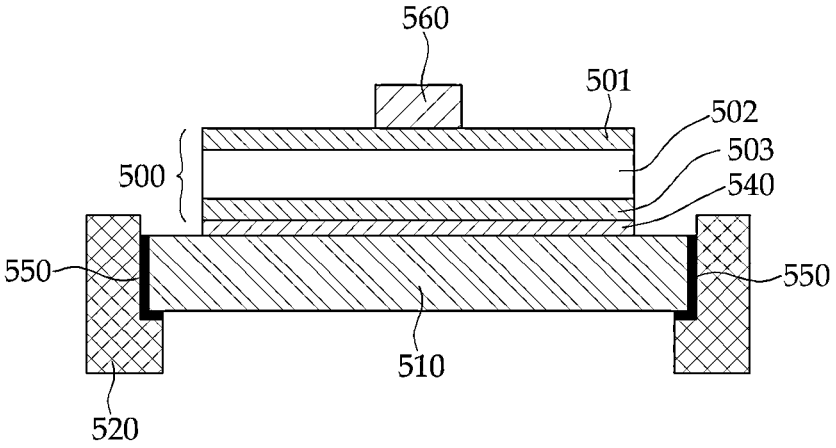

Referring to FIGS. 4 and 5, a piezoelectric speaker having a weight according to a first exemplary embodiment and a second exemplary embodiment of the present disclosure includes a piezoelectric device 400 or 500 having at least one piezoelectric layer 402 or 502 and electrodes 401 and 403, or 501 and 503 formed on or on and below the piezoelectric layer 402 or 502 to apply an electrical signal to the piezoelectric layer 402 or 502, an acoustic diaphragm 410 or 510 having a wider area than the piezoelectric device 400 or 500 and bonded on one surface of the piezoelectric device 400 or 500, a high elastic damping material layer 440 or 540 bonding the piezoelectric device 400 or 500 and the acoustic diaphragm 410 or 510, a frame 420 or 520 disposed in a form that surrounds a side surface of the acoustic diaphragm 410 or 510, a high elastic adhesive agent 450 or 550 bonding the acoustic diaphragm 410 or 510 and the frame 420 or 520, a weight 460 or 560 disposed above the acoustic diaphragm or above and below the acoustic diaphragm 410 or 510 to thereby control an amplitude of a resonant mode, and the like.

Here, the piezoelectric layer 402 or 502 converts the applied electrical signal to vibration and transfers the converted vibration to the acoustic diaphragm 410 or 510 to thereby form a dilatational wave in the air and output sound.

The piezoelectric layer 402 or 502 is a single-layered thin film formed by applying a grinding process to piezoelectric ceramic in a form of a thick film. Alternatively, the piezoelectric layer 402 or 502 includes layered piezoelectric ceramic in which a piezoelectric material is layered using a method such as coating, screen printing, and the like, and the like.

The piezoelectric layer 402 or 502 may include poly crystalline ceramic such as PZT, a single crystalline piezoelectric material such as PMN-PT, PZN-PT, PIN-PT, and PYN-PT, a flexible piezoelectric polymer material such as PVDF and PVDF-TrFE, a new lead-free piezoelectric material such as BNT ($BaNiTiO_3$) and BZT-BCT, and the like. The piezoelectric layer 402 or 502 may have a variety of shapes such as a rectangular shape, a circular shape, an oval shape, a polygonal shape, and the like.

The electrodes 401 and 403, or 501 and 503 are formed on the piezoelectric layer 402 or 502 or on and below the piezoelectric layer 402 or 502 to electrically open both side surfaces of the piezoelectric layer 402 or 502, thereby applying an electrical signal to the piezoelectric layer 402 or 502. In the case of forming an upper electrode and a lower electrode, it is possible to form an anode and a cathode on a piezoelectric layer by connecting the lower electrode of the piezoelectric layer to a predetermined upper area. In the present disclosure, interdigitate electrode may be employed for the electrodes 401 and 403, or 501 and 503.

The acoustic diaphragm 410 or 510 may be configured using at least one material, and may be configured as a hetero junction composite diaphragm of a flexible diaphragm material in charge of a lower register characteristic and a rigid diaphragm material in charge of the upper register. A flexible diaphragm includes rubber, silicone, urethane, and the like of which young's modulus is low and a vibration absorption rate is high. A rigid diaphragm may include plastic, metal, metal carbon nano tube (CNT), graphene, and the like of which young's modulus is high, and is configured to be thinner compared to a thickness of the flexible diaphragm. The acoustic diaphragm 410 or 510 may be configured as one of the flexible diaphragm and the rigid diaphragm, or may be configured as the hetero-junction composite diaphragm of the flexible diaphragm and the rigid diaphragm. The acoustic diaphragm 410 or 510 may be formed of a unit-structured nano composite material that is a material formed by synthesizing polymer such as rubber, silicone, urethane, and the like and a nano structure material such as CNT, graphene, and the like.

The acoustic diaphragm 410 and 510 is mounted to the piezoelectric layer 402 or 502 using the high elastic damping material layer 440 or 540. The high elastic damping material layer 440 or 540 may include silicon epoxy, thermosetting resin, and the like.

The frame 420 or 520 is disposed in the form that surrounds the side surface of the acoustic diaphragm 410 or 510 using the high elastic adhesive agent 450 or 550. To minimize anti-vibration occurring due to internal loss when the acoustic diaphragm 410 or 510 vibrates, the frame 420 or 520 may include plastic or aluminum including polybutyleneterephthalate (PBT), polyacetal (POM), poly carbonate (PC), and the like, or a metal or alloy including stainless steel. The frame 420 or 520 may be manufactured to have a thickness of less than or equal to 1 mm in order to prevent a size from being unnecessarily increased.

For a uniform frequency response characteristic and enhancement of sound quality of the piezoelectric speaker, the weight 460 or 560 disposed above the acoustic diaphragm or above and below the acoustic diaphragm 410 or 510 for controlling vibration functions to enhance distortion of vibration according to divisional vibration of the acoustic diaphragm 410 or 510. The weight 460 or 560 is formed of a flexible material that controls mutually crossing displacement of vibration. The flexible material includes silicone, rubber, vinyl, urethane, and the like.

The weight 460 or 560 is formed of a flexible material to assign great rigidity to the acoustic diaphragm 410 or 510 and thus, needs to be formed of a sufficiently flexible material not to cause movement of a resonant frequency. The weight 460 or 560 may have a form of epoxy or foam. When the weight 460 or 560 is in the form of epoxy or foam, the weight 460 or 560 is directly coated and hardened. When the weight 460 or 560 is not in the form of epoxy or foam, a method of disposing the weight 460 or 560 using high elastic epoxy may be employed.

Referring to FIGS. 4 and 5, the weight 460 or 560 according to an exemplary embodiment of the present disclosure may be disposed on an upper center and a lower left side and a lower right side of the acoustic diaphragm 410 or 510 in a parallel direction or may be disposed on an upper center thereof. In the case of a direction into which the weight 460 or 560 is to be disposed, the weight 460 or 560 may be disposed into a long shaft direction of the acoustic diaphragm 410 or 510 of the piezoelectric speaker. The weight 460 or 560 disposed above the acoustic diaphragm 410 or 510 may have a width of greater than or equal to ¼ of a short shaft length of the acoustic diaphragm 410 or 510, and have a length shorter than the long shaft length of the acoustic diaphragm 410 or 510, so that the weight 460 or 560 may control only the vibration, without significantly affecting the rigidity of the acoustic diaphragm 410 or 510.

As an effective method for preventing vibration of the acoustic diaphragm 410 distorted, a weight 470 disposed on a lower edge of the acoustic diaphragm 410 may be disposed on each of the lower left side and the lower right side of the acoustic diaphragm 410 in a parallel direction with an upper weight 460. Generally, the weight 470 disposed on the rear surface of the acoustic diaphragm 410 may be disposed not to overlap a position of the upper weight. Desirably, by dividing the short shaft length of the acoustic diaphragm 410 into three equal portions, the upper weight 460 may be disposed at a position of a center portion and the lower weight 470 may be disposed at a position of each of the left side and the right side. Each of the upper weight 460 and the lower weight 470 may have a width of about ¼ of the short shaft length of the acoustic diaphragm 410.

As shown in FIG. 5, the weight 560 may be disposed only on the upper center of the acoustic diaphragm 510 without being disposed below the acoustic diaphragm 510.

As shown in FIGS. 4 and 5, the shape of the weight 460 or 560 is not limited to the rectangular shape and thus, the weight 460 or 560 may also be provided in a similar oval shape and a polygonal shape.

A weight according to an exemplary embodiment of the present disclosure is to enhance the largest dip with respect to a frequency response characteristic of a piezoelectric speaker. However, for enhancement of a dip required based on a size of the piezoelectric speaker without being limited only to a configuration of the weight for controlling vibration in the (3, 3 ) mode according to an exemplary embodiment of the present disclosure, a configuration of the weight for controlling a high order mode such as a secondary mode or at least quartic mode may be applied.

Figure 6:
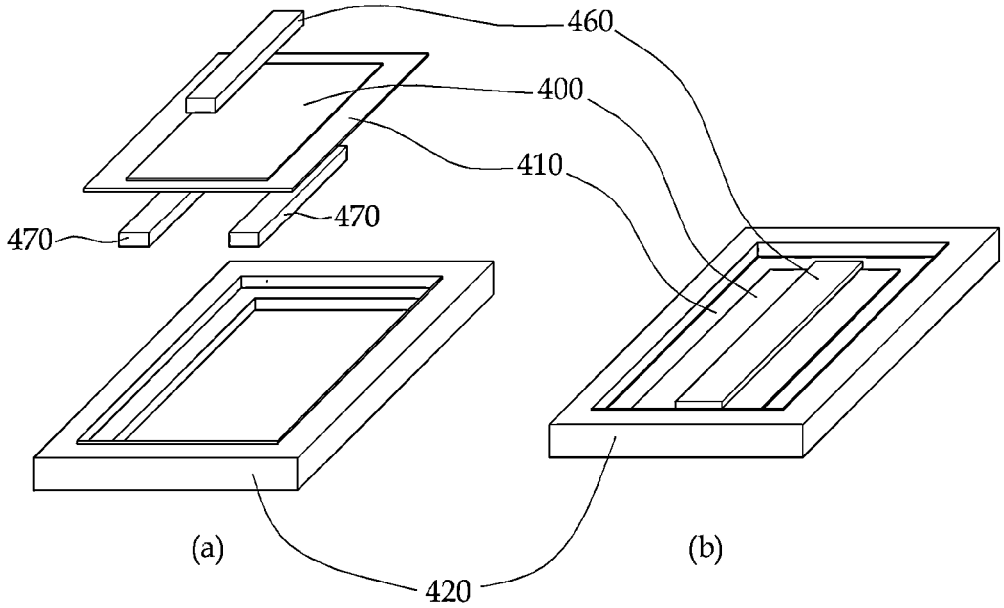
FIG. 6 is an exploded perspective view of the piezoelectric speaker according to the first exemplary embodiment of the present disclosure.
Figure 7:
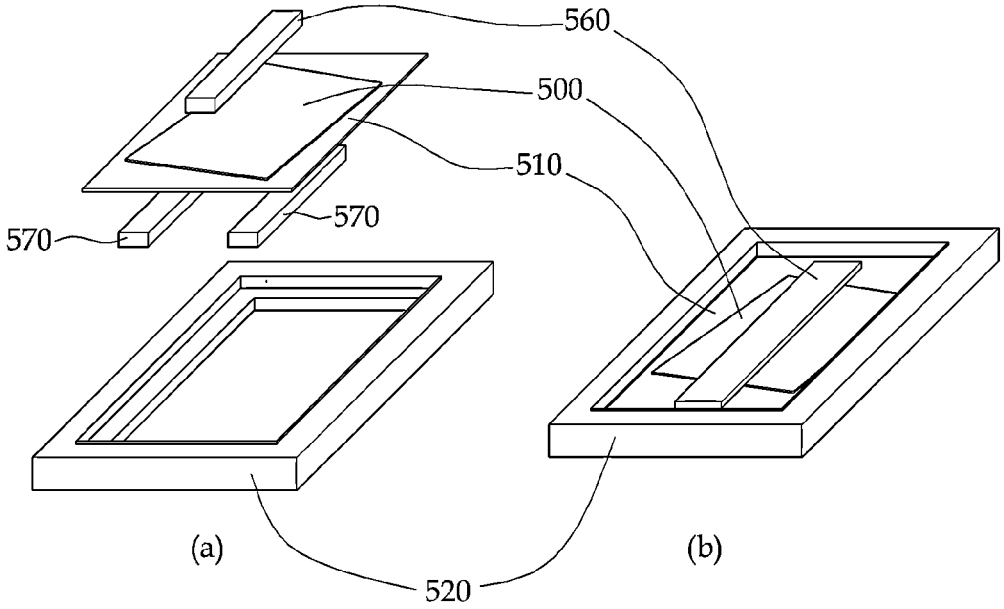
FIG. 7 is an exploded perspective view of a piezoelectric speaker according to a second exemplary embodiment of the present disclosure.

FIGS. 6 and 7 are exploded perspective views of the piezoelectric speaker according to the first exemplary embodiment and the second exemplary embodiment of the present disclosure, respectively. A method of assembling the above parts and disposing the weight in the piezoelectric speaker according to the present disclosure may be explained through the aforementioned description.

In FIG. 6, the piezoelectric layer 402 and the acoustic diaphragm 410 of the piezoelectric speaker are disposed in a symmetrical structure. In FIG. 7, the piezoelectric layer 502 and the acoustic diaphragm 510 of the piezoelectric speaker are disposed in an inclined structure or an asymmetrical structure.

The piezoelectric layer 502 illustrated in FIG. 7 may be formed on the acoustic diaphragm 510 in the inclined structure or a predetermined asymmetrical structure in order to avoid structural symmetry. Specifically, the piezoelectric layer 502 may be formed at an angle of $45<\alpha<90$ degrees with respect to the acoustic diaphragm 510. The inclined structure having an angle of 60 to 75 degrees may be most idealistic. That is, the piezoelectric layer 502 has the inclined structure so that stress at four vertices of the frame 520 may be uniform while avoiding the structural symmetry of up, down, left, and right of the piezoelectric speaker. The above inclined structure prevents mechanical vibration occurring in the piezoelectric layer 502 from forming a standing wave by the frame 520 of the piezoelectric speaker, thereby decreasing distortion of sound and enhancing sound quality.

Figure 8:
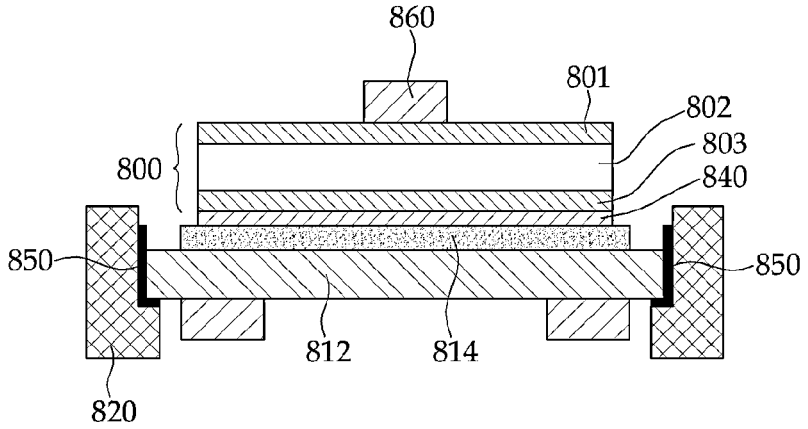
FIG. 8 is a cross-sectional view of a piezoelectric speaker according to a third exemplary embodiment of the present disclosure.

FIG. 8 is a cross-sectional view of a piezoelectric speaker according to a third exemplary embodiment of the present disclosure.

Referring to FIG. 8, an acoustic diaphragm according to the exemplary embodiment of the present disclosure has a configuration of a hetero junction composite diaphragm, and includes a flexible acoustic diaphragm 812 in charge of the lower register of the piezoelectric speaker and a rigid acoustic diaphragm 814 in charge of the upper and middle register of the piezoelectric speaker. The flexible acoustic diaphragm 812 is configured to have a wider area than the rigid acoustic diaphragm 814, and is fixed to a frame 820. That is, the outer periphery of the acoustic diaphragm is configured as the flexible acoustic diaphragm 812 along the frame 820 to thereby compensate for the lower register of the piezoelectric speaker. Accordingly, a weight 860 may be disposed within only an area in which the rigid acoustic diaphragm 814 is positioned. Through the configuration of the hetero junction composite diaphragm including the weight 860 and a step, it is possible to enhance the sound quality and the lower register of the piezoelectric speaker.

Figure 9:
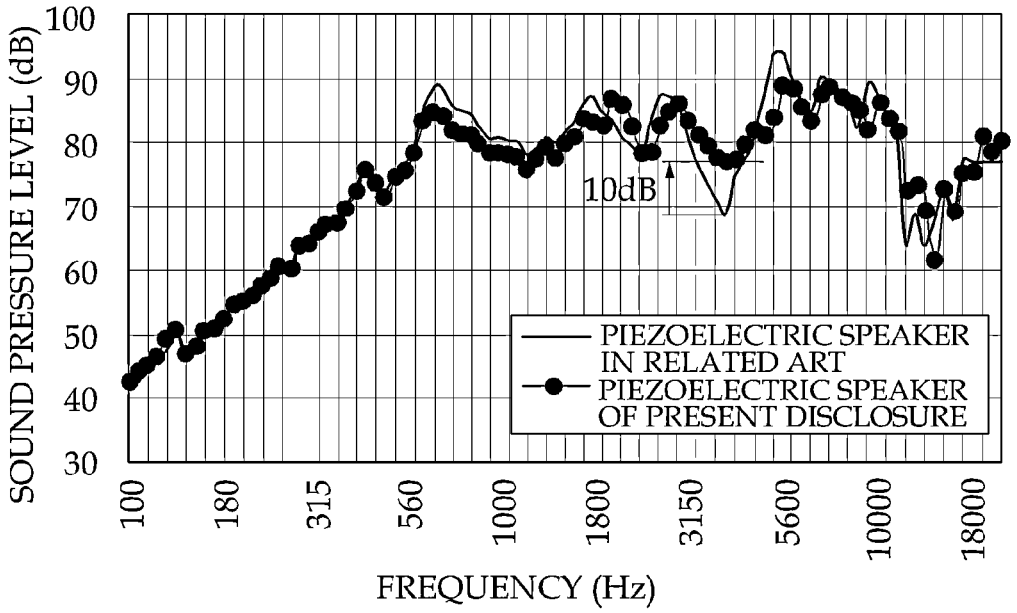
FIG. 9 is a graph illustrating a frequency response characteristic of a piezoelectric speaker according to an exemplary embodiment of the present disclosure.

FIG. 9 is a graph illustrating a frequency response characteristic of a piezoelectric speaker according to an exemplary embodiment of the present disclosure.

Referring to FIG. 9, it can be known that a dip in the (3, 3 ) mode of the piezoelectric speaker has been enhanced by about 10 dB or more by a weight for controlling vibration. That is, by the weight for controlling the vibration according to the exemplary embodiment of the present disclosure, it is possible to uniformly enhance a frequency response characteristic of the piezoelectric speaker, and to improve the sound quality.

Figure 10:
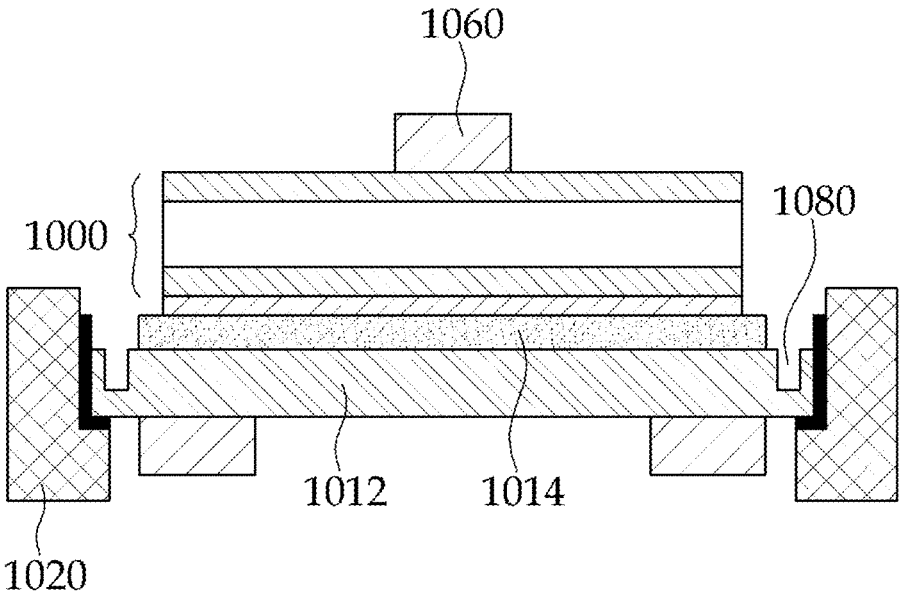
FIG. 10 is a cross-sectional view of a piezoelectric speaker according to a fourth exemplary embodiment of the present disclosure.

FIG. 10 is a cross-sectional view of a piezoelectric speaker according to a fourth exemplary embodiment of the present disclosure. Compared to the acoustic diaphragm according to the third exemplary embodiment of the present disclosure, in the piezoelectric speaker according to the fourth exemplary embodiment, a wrinkle shape 1080 in a predetermined pattern is formed on a flexible acoustic diaphragm 1012. In a hetero junction composite diaphragm including the flexible acoustic diaphragm 1012 and a rigid acoustic diaphragm 1014, the wrinkle shape 1080 of the flexible acoustic diaphragm 1012 may add flexibility to the flexible acoustic diaphragm 1012 in charge of the lower register and thereby further improve a reproduction characteristic in a low frequency. Therefore, the piezoelectric speaker according to the fourth exemplary embodiment of the present disclosure is designed in a structure to further significantly enhance a lower register characteristic and a sound quality characteristic by the flexible acoustic diaphragm 1012 having a wrinkle structure and a weight 1060.

Figure 11:
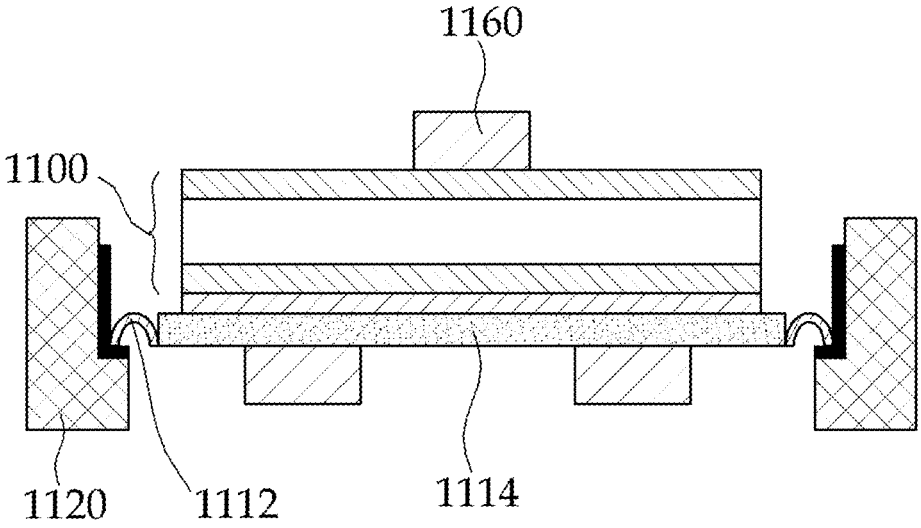
FIG. 11 is a cross-sectional view of a piezoelectric speaker according to a fifth exemplary embodiment of the present disclosure.

FIG. 11 is a cross-sectional view of a piezoelectric speaker according to a fifth exemplary embodiment of the present disclosure. Specifically, in a hetero junction composite acoustic diaphragm of the piezoelectric speaker, instead of disposing a rigid acoustic diaphragm 1114 and a flexible acoustic diaphragm 1112 on the whole surface, the flexible acoustic diaphragm 1112 is configured to be disposed only in a predetermined area along the inner periphery of a frame 1120. A center portion of an acoustic diaphragm that reproduces the upper register is configured using only the rigid acoustic diaphragm 1114 so as to vibrate with further great displacement and significantly improve an output characteristic. The flexible acoustic diaphragm 1112 configured as a predetermined area along the inner periphery of the frame 1120 is configured in an upwardly bent form to thereby function to enforce an output characteristic on a front portion of the piezoelectric speaker and to prevent distortion. Accordingly, by a configuration of the acoustic diaphragm including the flexible acoustic diaphragm 1112 and the rigid acoustic diaphragm 1114 and a weight 1160 for controlling vibration according to the fifth exemplary embodiment of the present disclosure, it is possible to improve an output sound pressure characteristic of the piezoelectric speaker and to prevent distortion of the diaphragm, thereby achieving the uniform and excellent sound quality.

Figure 12:
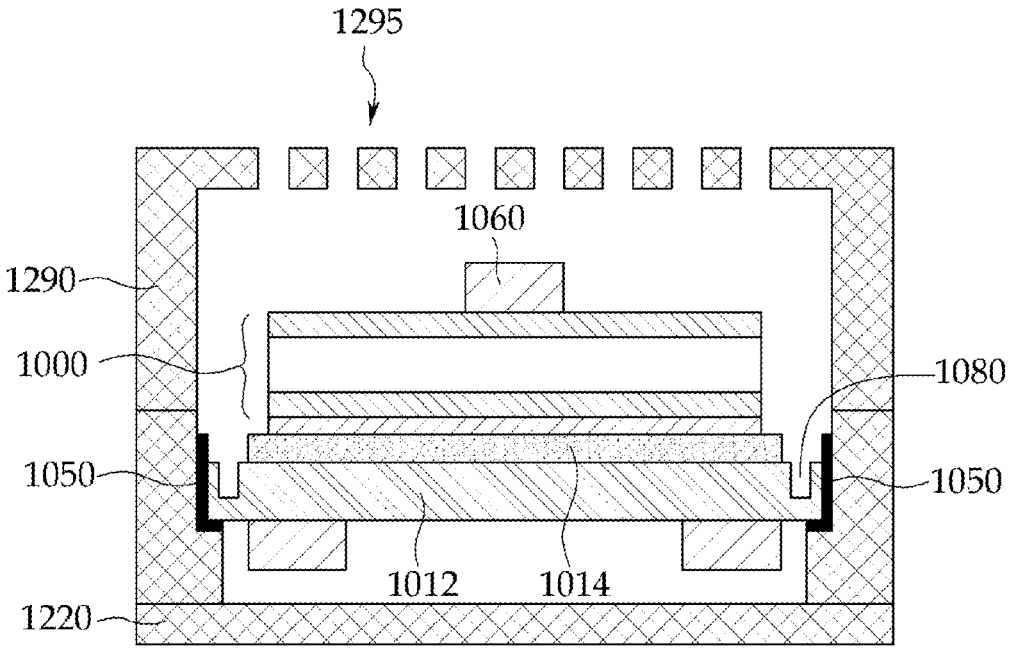
FIG. 12 is a cross-sectional view of the piezoelectric speaker according to the fourth exemplary embodiment of the present disclosure packaged with a protective cap having a plurality of sound holes and an enclosure.

FIG. 12 is a cross-sectional view of the piezoelectric speaker according to the fourth exemplary embodiment of the present disclosure packaged with a protective cap having a plurality of sound holes and an enclosure.

Referring to FIG. 12, the piezoelectric speaker is packaged with the enclose 1220 that blocks irradiation of sound from a rear of the acoustic diaphragm and the protective cap 1290 that protects a front of the piezoelectric speaker. The protective cap 1290 disposed at a predetermined interval from the front of the piezoelectric speaker and the enclosure 1220 disposed at the rear are assembled to thereby completely package the piezoelectric speaker. The plurality of sound holes 1295 is formed in a front surface of the protective cap 1290. The plurality of sound holes 1295 formed in the front surface of the protective cap 1290 may be disposed in a variety of shapes that do not distort a sound irradiation characteristic of the piezoelectric speaker. The plurality of sound holes 1295 in a circular shape, an oval shape, a polygonal shape, a new moon shape, and the like, respectively, may be disposed in a matrix form.

Additionally, felt (not shown) protecting the plurality of sound holes 1295 may be disposed on the protective cap 1290.

Figure 13:
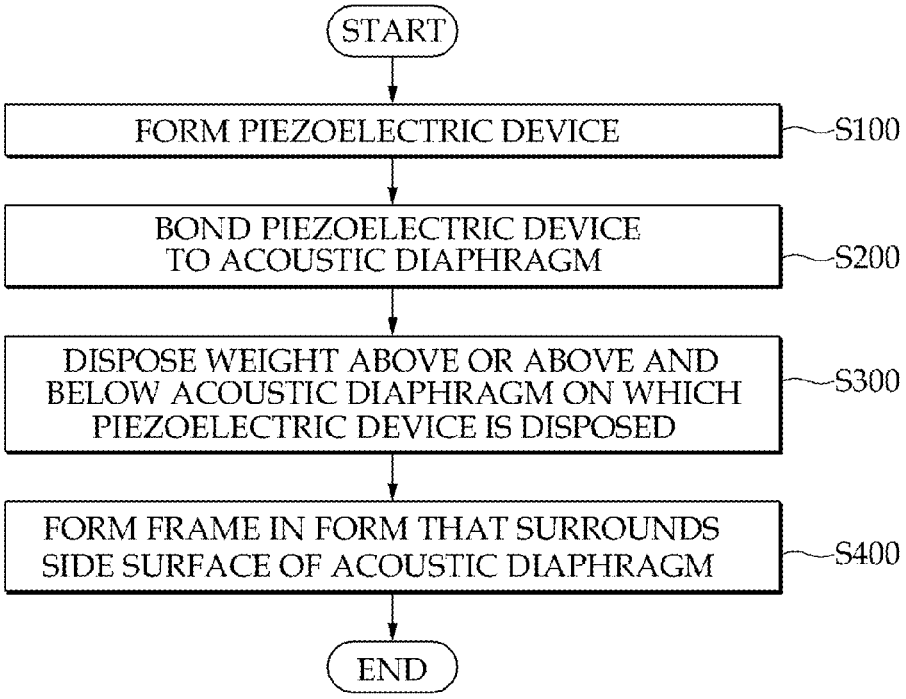
FIG. 13 is a flowchart to describe a method of producing a piezoelectric speaker having a weight according to an exemplary embodiment of the present disclosure.

FIG. 13 is a flowchart to describe a method of producing a piezoelectric speaker having a weight according to an exemplary embodiment of the present disclosure.

In a method of producing a piezoelectric speaker having a weight according to an exemplary embodiment of the present disclosure, a piezoelectric device is initially formed by layering an electrode on or on and below a piezoelectric layer (S100).

Here, the piezoelectric layer is a single-layered thin film formed by applying a grinding process to piezoelectric ceramic in a form of a thick film. Alternatively, the piezoelectric layer includes layered piezoelectric ceramic in which a piezoelectric material is layered using a method such as coating, screen printing, and the like, and the like.

The piezoelectric layer may have a variety of shapes such as a rectangular shape, a circular shape, an oval shape, a polygonal shape, and the like.

Next, the piezoelectric device is bonded on an acoustic diaphragm using a high elastic damping material (S200).

Next, a weight of a flexible material is disposed above the acoustic diaphragm on which the piezoelectric device is bonded (S300).

The weight is disposed above the acoustic diaphragm or above and below the acoustic diaphragm. In the case of disposing the weight above the acoustic diaphragm, an upper weight is disposed along a center of the acoustic diaphragm in a long shaft direction of the acoustic diaphragm. In the case of disposing the weight below the acoustic diaphragm, lower weights are positioned not to overlap the upper weight and are disposed to be in parallel on a lower left side and a lower right side of the acoustic diaphragm.

The upper weight and the lower weight have a width of greater than or equal to ¼ of a short shaft length of the acoustic diaphragm and have a length shorter than a long shaft length of the acoustic diaphragm.

In order to enhance distortion of vibration according to divisional vibration of the acoustic diaphragm, the weight is formed of a flexible material that controls mutually crossing displacement of vibration. The flexible material includes silicone, rubber, vinyl, urethane, and the like.

Finally, a frame is formed in a form that surrounds a side surface of the acoustic diaphragm (S400).

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A piezoelectric speaker, comprising:

a piezoelectric device including a piezoelectric layer and one or more electrodes disposed on the piezoelectric layer or on and below the piezoelectric layer to apply an electrical signal to the piezoelectric layer;

an acoustic diaphragm having a wider area than the piezoelectric device and disposed below the piezoelectric device;

a frame disposed in a form that surrounds a side surface of the acoustic diaphragm;

one or more upper weights disposed above the acoustic diaphragm on which the piezoelectric device is disposed; and one or more lower weights disposed below the acoustic diaphragm on which the piezoelectric device is disposed, wherein the one or more lower weights are disposed not to overlap a position of the one or more upper weights lengthwise, wherein the acoustic diaphragm includes a stacked structure of a first acoustic diaphragm and a second acoustic diaphragm, and wherein the first acoustic diaphragm is flexible and attached to the frame and has a young's modulus lower than the second acoustic diaphragm, and the second acoustic diaphragm is rigid and disposed on the first acoustic diaphragm.

2. The piezoelectric speaker of claim 1, wherein an upper weight is disposed along a central portion of the acoustic diaphragm in a long shaft direction of the acoustic diaphragm.

3. The piezoelectric speaker of claim 2, wherein the one or more lower weights are positioned to be in parallel on a lower left side and a lower right side of a rear surface of the acoustic diaphragm with respect to the central portion.

4. The piezoelectric speaker of claim 1, wherein the one or more upper weights and the one or more lower weights have a width of greater than or equal to ¼ of a short shaft length of the acoustic diaphragm and have a length shorter than a long shaft length of the acoustic diaphragm.

5. The piezoelectric speaker of claim 1, wherein a material of the piezoelectric layer comprises any one of PZT, PMN-PT, PZN-PT, PIN-PT, PYN-PT, PVDF, PVDF-TrFE, BNT ($BaNiTiO_3$), and BZT-BCT.

6. The piezoelectric speaker of claim 1, wherein the piezoelectric layer is disposed on the acoustic diaphragm in an inclined structure or an asymmetric structure in order to prevent a standing wave from being formed.

7. A piezoelectric speaker, comprising:

a piezoelectric device including a piezoelectric layer and one or more electrodes disposed on the piezoelectric layer or on and below the piezoelectric layer to apply an electrical signal to the piezoelectric layer;

an acoustic diaphragm having a wider area than the piezoelectric device and disposed below the piezoelectric device;

a frame disposed in a form that surrounds a side surface of the acoustic diaphragm;

one or more upper weights disposed above the acoustic diaphragm; and one or more lower weights disposed below the acoustic diaphragm, wherein the one or more lower weights are disposed not to overlap a position of the one or more upper weights lengthwise, wherein the acoustic diaphragm includes a stacked structure of a first acoustic diaphragm and a second acoustic diaphragm, wherein the first acoustic diaphragm is flexible and attached to the frame and has a young's modulus lower than the second acoustic diaphragm, and the second acoustic diaphragm is rigid and disposed on the first acoustic diaphragm, and wherein the acoustic diaphragm includes a nano-composite material that is formed by synthesizing a polymer and a nano structure material.

8. The piezoelectric speaker of claim 1, wherein the first acoustic diaphragm comprises any one of rubber, silicone, and urethane.

9. The piezoelectric speaker of claim 1, wherein the second acoustic diaphragm comprises any one of plastic, metal, carbon nano tube (CNT), and graphene.

10. The piezoelectric speaker of claim 7, wherein the nano structure material includes CNT or graphene.

11. The piezoelectric speaker of claim 1, wherein the first acoustic diaphragm and the second acoustic diaphragm are stacked using one of bonding, coating, and depositing.

12. The piezoelectric speaker of claim 1, wherein the first acoustic diaphragm has a relatively wide area compared to the second acoustic diaphragm and is fixed to the frame, and the second acoustic diaphragm is spaced apart from the frame.

13. The piezoelectric speaker of claim 12, wherein a wrinkle is formed in a predetermined area of the first acoustic diaphragm in which the second acoustic diaphragm is absent to thereby add a flexibility.

14. The piezoelectric speaker of claim 1, wherein the frame is configured in an enclosure form that blocks sound irradiation from a rear of the acoustic diaphragm, and is spaced apart from a bottom surface of the acoustic diaphragm to thereby form a predetermined space.

15. The piezoelectric speaker of claim 14, further comprising:

a protective cap housing a front surface of the piezoelectric speaker and having a plurality of sound holes formed in the front surface of the protective cap.

16. A method of producing a piezoelectric speaker, the method comprising:

forming a piezoelectric device;

forming an acoustic diaphragm;

bonding the piezoelectric device on the acoustic diaphragm using a high elastic damping material;

disposing one or more upper weights of a flexible material above the acoustic diaphragm on which the piezoelectric device is bonded along a central portion of the acoustic diaphragm in a long shaft direction of the acoustic diaphragm;

disposing one or more lower weights below the acoustic diaphragm on which the piezoelectric device is disposed; and disposing a frame in a form that surrounds a side surface of the acoustic diaphragm, wherein the one or more lower weights are disposed not to overlap a position of the one or more upper weights lengthwise, wherein forming the acoustic diaphragm includes:

forming a first acoustic diaphragm that is flexible; and forming a second acoustic diaphragm on the first acoustic diaphragm, the second acoustic diaphragm being rigid, wherein the first acoustic diaphragm has a young's modulus lower than the second acoustic diaphragm, and wherein the first acoustic diaphragm is attached to the frame.

17. The method of claim 16, wherein the one or more lower weights are disposed to be in parallel on a lower left side and a lower right side of a rear surface of the acoustic diaphragm with respect to the central portion.

18. The method of claim 17, wherein the one or more upper weights and the one or more lower weights have a width of greater than or equal to ¼ of a short shaft length of the acoustic diaphragm, and have a length shorter than a long shaft length of the acoustic diaphragm.

19. The piezoelectric speaker of claim 7, wherein the piezoelectric layer is disposed on the acoustic diaphragm in an inclined structure or an asymmetric structure in order to prevent a standing wave from being formed.

20. The method of claim 16, wherein bonding the piezoelectric device on the acoustic diaphragm comprises disposing the piezoelectric layer on the acoustic diaphragm in an inclined structure or an asymmetric structure in order to prevent a standing wave from being formed.

* * * * *